US008704464B2

(12) United States Patent
Sasaki et al.

(10) Patent No.: US 8,704,464 B2
(45) Date of Patent: Apr. 22, 2014

(54) CHARGED PARTICLE TRAJECTORY CONTROL APPARATUS, CHARGED PARTICLE ACCELERATOR, CHARGED PARTICLE STORAGE RING, AND DEFLECTION ELECTROMAGNET

(75) Inventors: Shigemi Sasaki, Hiroshima (JP); Atsushi Miyamoto, Hiroshima (JP)

(73) Assignee: Hiroshima University, Hiroshima (JP)

( * ) Notice: Subject to any disclaimer, the term of this patent is extended or adjusted under 35 U.S.C. 154(b) by 0 days.

(21) Appl. No.: 13/995,606

(22) PCT Filed: Dec. 19, 2011

(86) PCT No.: PCT/JP2011/079423

§ 371 (c)(1), (2), (4) Date: Jun. 19, 2013

(87) PCT Pub. No.: WO2012/086612

PCT Pub. Date: Jun. 28, 2012

(65) Prior Publication Data

US 2013/0270452 A1 Oct. 17, 2013

(30) Foreign Application Priority Data

Dec. 20, 2010 (JP) ..... 2010-283850

(51) Int. Cl.
*H05H 11/00* (2006.01)

(52) U.S. Cl.
USPC ..... 315/503; 250/492.1; 250/492.2; 250/492.3; 250/396 ML; 250/453.11; 250/454.11

(58) Field of Classification Search
USPC ..... 250/396 R, 492.1, 492.2, 492.3, 396 ML, 250/453.11, 454.11; 315/503
See application file for complete search history.

(56) References Cited

PUBLICATIONS

Miyamoto,A., and Sasaki, S., "HiSOR-II, Compact light source with a torus-knot type accumulator ring", 11th International Conference on Synchrotron Radiation Instrumentation (SRI 2012), Journal of Physics: Conference Series 425, 042017 (2013).*

* cited by examiner

*Primary Examiner* — Jack Berman
*Assistant Examiner* — Meenakshi Sahu
(74) *Attorney, Agent, or Firm* — K&L Gates LLP; Louis C. Cullman; Michelle Glasky Bergman

(57) ABSTRACT

A charged particle orbit control device (100) is used in a ring-shaped charged particle accelerator or a charged particle storage ring. The charged particle orbit control device (100) is configured to enable the orbit of a charged particle to return to the original orbit in multiple cycles. The charged particle orbit control device (100) includes multiple bending magnets (1) that bend the charged particle (3). In the charged particle orbit control device (100), the bending angle and relative position of each bending magnet (1) are prescribed such that every time the charged particle (3) passes through, the orbit of the charged particle (3) in each bending magnet (1) alternately switches between two orbits.

12 Claims, 26 Drawing Sheets

CHARGED PARTICLE TRAJECTORY CONTROL APPARATUS, CHARGED PARTICLE ACCELERATOR, CHARGED PARTICLE STORAGE RING, AND DEFLECTION ELECTROMAGNET

TECHNICAL FIELD

The present invention relates to a charged particle orbit control device, a charged particle accelerator, a charged particle storage ring and a bending magnet that control the ring-shaped orbits of charged particles.

BACKGROUND ART

Major types of ring-shaped charged particle accelerators include cyclotrons and synchrotrons. With a cyclotron, the orbital radius of an accelerating charged particle increases as its energy rises. On the other hand, with a synchrotron, the strength of the bending magnets increases in synchronization with the rising energy of an accelerating charged particle, and thus the orbit of the accelerating charged particle is kept constant.

Besides being used as high-energy accelerators for electrons (positrons) and protons, synchrotron-type charged particle accelerators and charged particle storage rings are currently being built and operated worldwide as rings for radiation sources of various size (see Non Patent Literature 1 to 5, for example). Also, a large number of synchrotron facilities that accelerate and store protons or carbon ions provided for medical use are being built recently (see Non Patent Literature 6 to 8, for example).

Particle orbits in these synchrotron accelerators disclosed in Non Patent Literature 1 to 8 all close in one cycle. In other words, charged particles in the accelerators return to their original orbit in one cycle around the ring.

CITATION LIST

Non Patent Literature

Non Patent Literature 1: H. Yokomizo, S. Sasaki, et al., "Design of a small storage ring in JAERI", Proceedings of EPAC88, 1988, p. 455

Non Patent Literature 2: W. Namkung, "Review of third generation light sources." Proceedings of IPAC10, Kyoto, Japan, 2010, WEXRA01

Non Patent Literature 3: S. Koda, et al., "Progress and status of synchrotron radiation facility Saga Light Source." ibid, WEPEA040

Non Patent Literature 4: M. Adachi, et al., "Present status and upgrade plan on coherent light source developments at UVSOR-II." ibid, WEPEA038

Non Patent Literature 5: A. Miyamoto, et al., "HiSOR-II future plan of Hiroshima Synchrotron Radiation Center." ibid, WEPEA029

Non Patent Literature 6: S. Yamada, et al., "The progress of HIMAC and particle therapy facilities in Japan.", Proceeding of 2nd Asian Particle Accelerator Conference, Beijing, China, 2001, p. 829

Non Patent Literature 7: T. Furukawa, et al., "Design of synchrotron and transport line for carbon therapy facility and related machine study at HIMAC.", Nucl. Instrum. Methods, A562 (2006) 1050

Non Patent Literature 8: K. Noda, et al., "New treatment research facility project at HIMAC.", Proceedings of IPAC10, Kyoto, Japan, 2010, TUOCRA01

SUMMARY OF INVENTION

Technical Problem

In this way, ring-shaped charged particle accelerators and charged particle storage rings for radiation sources are being designed and manufactured such that a charged particle bunch (bunch) assumes the same ring orbit every cycle around the ring. In other words, in the charged particle accelerators and charged particle storage rings of the related art, one ring cycle becomes one period of the ring orbit.

In this case, the maximum number of storable bunches is uniquely determined by the RF frequency and the length of one ring cycle (path length). In the case of storing one bunch per cycle, the time interval at which a bunch arrives at a place on the ring is uniquely determined by the path length.

Thus, for example, in the case of conducting time-of-flight (TOF) that tracks the change over time in the electronic state of matter excited by radiation pulses, the maximum value of the pulse interval is determined by the ring path length, and thus tracking the process of the change all the way to the end becomes difficult if the ring path length is short.

In other words, with the charged particle accelerators and charged particle storage rings of the related art, since the time during which a bunch cycles and returns to its original orbit is determined by the path length, small-scale rings with short path lengths make it difficult to obtain a long bunch interval necessary for experiments such as TOF in research that utilizes radiation, even in the case of conducting single-bunch operation. In addition, the maximum number of storable charged particles is also determined by the maximum number of bunches, which is determined by the path length.

Furthermore, with an electron synchrotron which is used as a radiation source, a high-intensity light-emitting device called an insertion device is typically installed on the straight parts of the ring. With a ring that returns to the original orbit in one cycle, the number of straight parts where an insertion device is installable becomes limited.

The present invention, being devised in light of the foregoing circumstances, takes as an object to provide a ring-shaped charged particle orbit control device, a charged particle accelerator, a charged particle storage ring, and a bending magnet able to substantially lengthen the path length within the same installation area.

Solution to Problem

In order to achieve the above object, a charged particle orbit control device according to a first aspect of the present invention is used in a ring-shaped charged particle accelerator or a charged particle storage ring, is configured to enable a charged particle to return to an original orbit in a plurality of cycles, and includes a plurality of bending magnets that bend the charged particle, wherein the bending angle and relative position of each bending magnet are predetermined such that every time the charged particle passes through, an orbit of the charged particle in each bending magnet alternately switches between two orbits.

In another possible configuration, the bending angle and the relative position of each bending magnet are predetermined such that every time the charged particle passes through, an incident position of the charged particle incident on each bending magnet alternately switches between two positions.

In another possible configuration, the bending angle and the relative position of each bending magnet are predetermined such that every time the charged particle passes through, an incident angle of the charged particle incident on each bending magnet alternately switches between two angles.

In another possible configuration, in each bending magnet, a magnetic field gradient is formed from an inner side to an outer side of the orbit of the charged particle.

In another possible configuration, provided that n is a natural number that is not a multiple of m, each bending magnet is disposed on an outer rim of an n-sided regular polygon, and configured such that the charged particle returns to the original orbit in m cycles (where m is a natural number other than 1).

In another possible configuration, each bending magnet bends the charged particle such that the orbit of the cycling charged particle contains part of each edge of the n-sided regular polygon, and in addition, the charged particle travels along every (m−1)th edge of the n-sided regular polygon.

In another possible configuration, m is 3, the bending magnets are respectively disposed at each vertex of the n-sided regular polygon, bend a charged particle arriving from a neighboring vertex on one side towards a vertex neighboring a neighboring vertex on the other side, and bend the charged particle arriving from another vertex neighboring the neighboring vertex on the one side towards the neighboring vertex on the other side.

In another possible configuration, a bending magnet that bends the charged particle exiting each vertex towards a neighboring vertex is additionally provided between each vertex of the n-sided regular polygon.

In another possible configuration, n is a natural number that is neither a multiple of 2 nor a multiple of 3, and an electromagnet power source that controls the magnetic force of each of the plurality of bending magnets is additionally provided, wherein the electromagnet power source, by adjusting the magnetic force of each of the plurality of bending magnets, is able to switch m among the natural numbers 1 through 3.

In a charged particle accelerator according to a second aspect of the present invention, an orbit of a charged particle is controlled by a charged particle orbit control device according to the present invention.

In a charged particle storage ring according to a third aspect of the present invention, an orbit of a charged particle is controlled by a charged particle orbit control device according to the present invention.

A bending magnet according to a fourth aspect of the present invention is used in a charged particle orbit control device according to the present invention, the bending magnet receives a charged particle incident from different positions, includes a plurality of different orbits for the charged particle depending on an incident position, and ejects the charged particle from a plurality of different positions according to each of the different orbits.

Advantageous Effects of Invention

According to the present invention, the number of cycles in which a charged particle returns to the original orbit is set to be multiple cycles, and thus the path length is substantially doubled or more within the same installation area. Lengthening the path length exhibits the advantages indicated below.

(1) In TOF conducted with a small-scale radiation source electron storage ring (time-resolved photoemission spectroscopy experiments, for example), it becomes possible to track the change over time in the electronic state of matter all the way to the end state.

(2) Since the path length is doubled or tripled within the same installation area, the maximum number of charged particles storable in the ring is also doubled or tripled, and thus in the case of application to an accelerator for medical applications, such as for radiation therapy, for example, the radiation dose potentially radiated in a beam onto an affected area is significantly increased.

(3) The number of straight parts allowing insertion of an insertion device is significantly increased, and thus, it becomes possible to install a greater number of experimental stations able to utilize high-intensity light.

(4) It becomes possible to configure a charged particle accelerator and charged particle storage ring in a small space at low cost. Also, according to the present invention, each bending magnet is disposed such that the orbit of the charged particle alternately switches every time the charged particle passes through a bending magnet. Thus, the present invention exhibits the following advantages.

(5) The number of straight lines in the orbit of the charged particle with respect to the number of bending magnets is further increased.

(6) It is possible to increase the number of bending magnets through which the charged particle passes during one cycle, and thus it is possible to decrease the bending angle while increasing the number of straight lines, and realize lower emittance.

DESCRIPTION OF EMBODIMENTS

Embodiments of the present invention will be described in detail and with reference to the drawings.

First Embodiment

First, a first embodiment of the present invention will be described.

Figure 1:
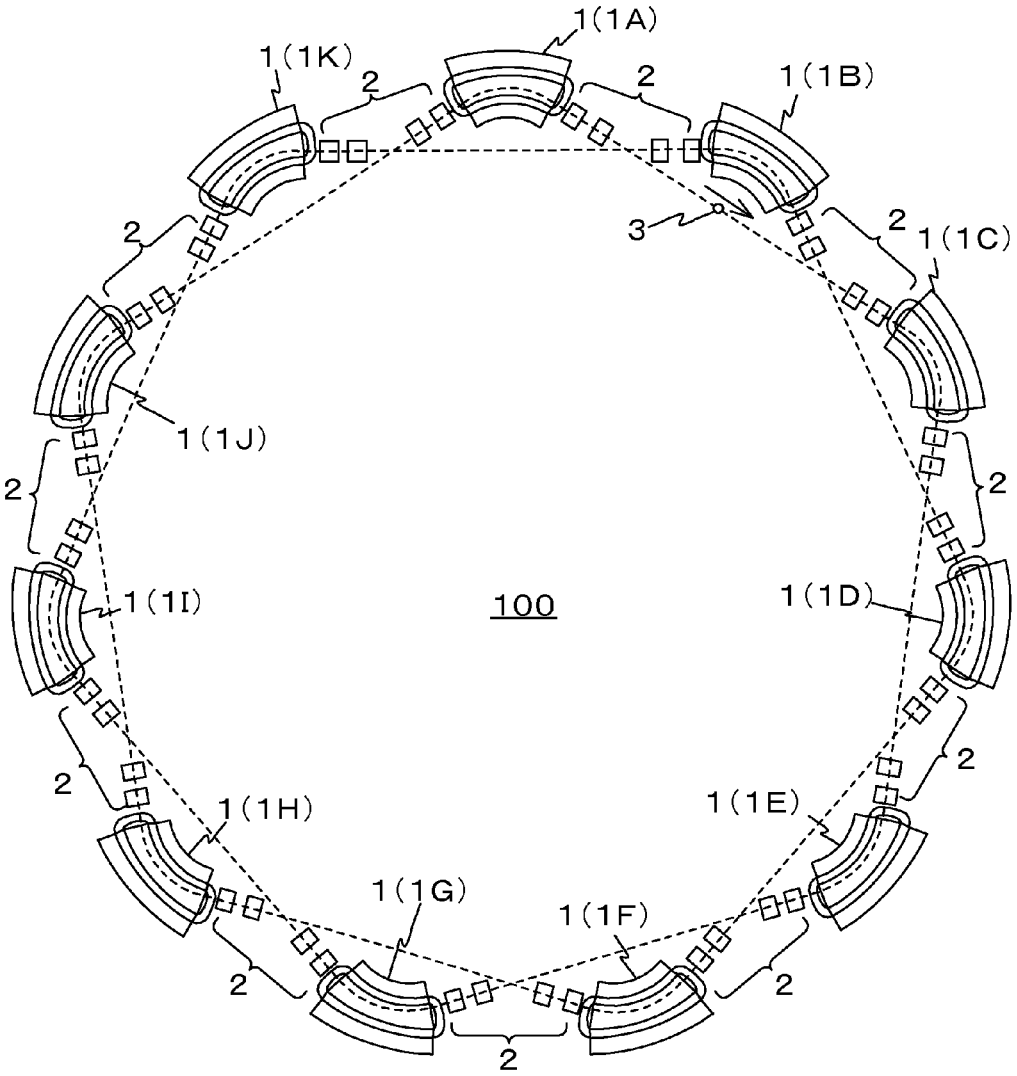
FIG. 1 is a top view illustrating a configuration of a charged particle orbit control device according to the first embodiment of the present invention.

First, a configuration of a charged particle orbit control device 100 according to the present embodiment will be described with reference to FIG. 1. As illustrated in FIG. 1, the charged particle orbit control device 100 is equipped with multiple bending magnets 1 (1A to 1K), and multiple quadrupole electromagnets 2.

The bending magnets 1 (1A to 1K) are respectively disposed at the vertices of a regular hendecagon. In other words, in the present embodiment, the number of cycles m is 2, the number of edges n is 11, and n is not a multiple of m.

The bending magnets 1 (1A to 1K) bend a charged particle 3. The bending magnets 1 (1A to 1K) bend the charged particle 3 such that the charged particle 3 passes through every other vertex of the regular hendecagon. For example, the bending magnet 1A bends the charged particle 3 arriving from the bending magnet 1J towards the bending magnet 1C.

In FIG. 1, the orbit of the charged particle 3 is indicated with broken lines. As FIG. 1 demonstrates, the charged particle 3 passes through every other vertex of the regular hendecagon.

The quadrupole electromagnets 2 are disposed along the orbit of the charged particle 3. The quadrupole electromagnets 2 inhibit scattering of a charged particle bunch made up of charged particles 3.

Note that in FIG. 1, features such as an RF cavity that accelerates the charged particle 3 is omitted from illustration.

Figure 2:
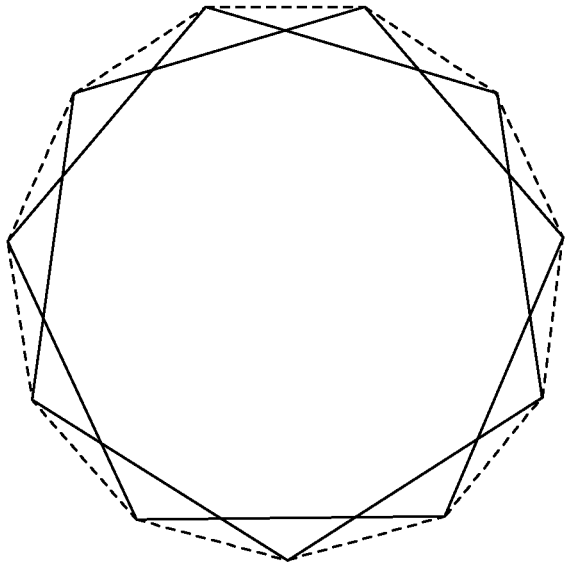
FIG. 2 is a diagram illustrating charged particle orbit shapes in the charged particle orbit control device in FIG. 1.

In FIG. 2, polygons approximately indicating the orbit of the charged particle 3 in the charged particle orbit control device 100 are illustrated with solid lines. As illustrated in FIG. 2, the particle orbit bends in the charged particle orbit control device 100 have 11-fold rotational symmetry, with the orbit intersecting on the straight parts. These particle orbit bends are also designated vertex-type, for example.

In the charged particle orbit control device 100, the charged particle 3 returns to the original orbit in two cycles. In other words, in the present embodiment, m=2.

In the charged particle orbit control device 100 according to the present embodiment, the number of cycles in which the charged particle 3 returns to the original orbit is two cycles, with two ring cycles making one period. Thus, the path length is substantially doubled or more within the same installation area. Lengthening the path length exhibits the advantages indicated below.

(1) In the case of single-bunch operation, the bunch interval is doubled. For example, in TOF experiments conducted with a small-scale radiation source electron storage ring (time-resolved photoemission spectroscopy experiments, for example), it becomes possible to track the change over time in the electronic state of matter all the way to the end state.

(2) In the case of multi-bunch operation, the amount of stored charge is doubled at maximum. For example, since the path length is doubled within the same installation area, the maximum number of charged particles storable in the ring is also doubled. Thus, in the case of application to an accelerator for medical applications, such as for radiation therapy, for example, the radiation dose radiated in a beam onto an affected area is significantly increased.

(3) The number of straight parts allowing insertion of an insertion device or RF cavity is significantly increased. Thus, it becomes possible to install a greater number of experimental stations able to utilize high-intensity light.

(4) It becomes possible to configure a charged particle accelerator and charged particle storage ring in a small space at low cost.

Note that the lattice in which the number of cycles is 2 is not limited to being a regular hendecagon.

Figure 3A:
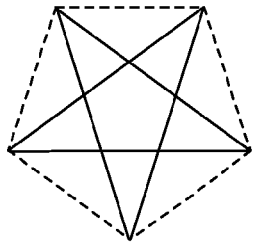
FIG. 3A is a diagram illustrating particle orbit bends in a regular pentagonal charged particle orbit control device (vertex-type) having a two-cycle orbit.

For example, it is also possible to form a regular pentagonal lattice, as illustrated in FIGS. 3A to 3D. FIG. 3A illustrates particle orbit bends (vertex-type) when the charged particle 3 is bent such that the charged particle 3 passes through every other vertex of a regular pentagon.

Figure 3B:
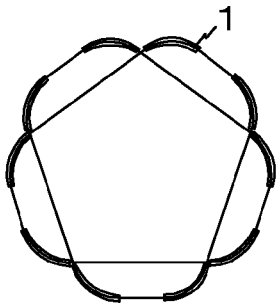
FIG. 3B is a diagram illustrating a modified particle orbit in a regular pentagonal charged particle orbit control device having a two-cycle orbit.
Figure 3C:
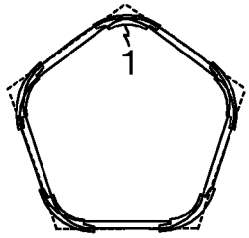
FIG. 3C is a diagram illustrating a configuration of a regular pentagonal charged particle orbit control device (edge-type) having a two-cycle orbit.
Figure 3D:
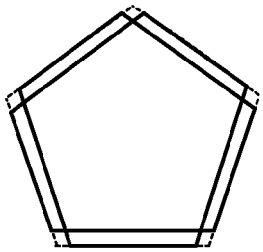
FIG. 3D is a diagram illustrating particle orbit bends in a regular pentagonal charged particle orbit control device (edge-type) having a two-cycle orbit.

It is possible to modify the shape of the lattice in a regular pentagon as illustrated in FIGS. 3B and 3C. With this lattice, it is ultimately possible to modify the shape to have what is called an edge-type particle orbit, as illustrated in FIG. 3D. With an edge-type lattice, the bending magnets 1 bend the charged particle 3 such that the orbit of the cycling charged particle 3 contains part of each edge of the regular pentagon, and in addition, the charged particle 3 travels along every other edge of the regular pentagon.

Figure 4A:
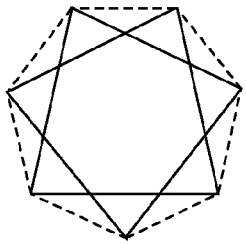
FIG. 4A is a diagram illustrating particle orbit bends in a regular heptagonal charged particle orbit control device (vertex-type) having a two-cycle orbit.

As another example, it is also possible to form a regular heptagonal lattice, as illustrated in FIGS. 4A to 4D. FIG. 4A illustrates particle orbit bends (vertex-type) when the charged particle 3 is bent such that the charged particle 3 passes through every other vertex of a regular heptagon.

Figure 4B:
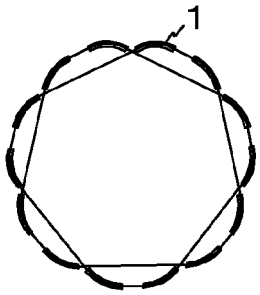
FIG. 4B is a diagram illustrating a modified particle orbit in a regular heptagonal charged particle orbit control device having a two-cycle orbit.
Figure 4C:
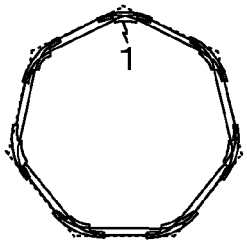
FIG. 4C is a diagram illustrating a configuration of a regular heptagonal charged particle orbit control device (edge-type) having a two-cycle orbit.
Figure 4D:
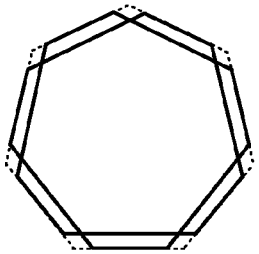
FIG. 4D is a diagram illustrating particle orbit bends in a regular heptagonal charged particle orbit control device (edge-type) having a two-cycle orbit.

It is possible to modify the shape of the lattice in a regular heptagon as illustrated in FIGS. 4B and 4C. With this lattice, it is ultimately possible to modify the shape to have an edge-type particle orbit, as illustrated in FIG. 4D. With an edge-type lattice, the bending magnets 1 bend the charged particle 3 such that the orbit of the cycling charged particle 3 contains part of each edge of the regular heptagon, and in addition, the charged particle 3 travels along every other edge of the regular heptagon.

Figure 5A:
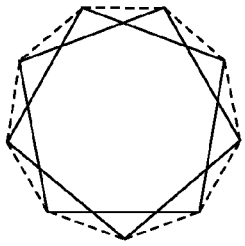
FIG. 5A is a diagram illustrating particle orbit bends in a regular nonagonal charged particle orbit control device (vertex-type) having a two-cycle orbit.

As another example, it is also possible to form a regular nonagonal lattice, as illustrated in FIGS. 5A to 5D. FIG. 5A illustrates particle orbit bends (vertex-type) when the charged particle 3 is bent such that the charged particle 3 passes through every other vertex of a regular nonagon.

Figure 5B:
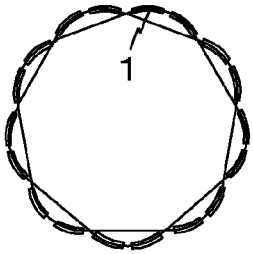
FIG. 5B is a diagram illustrating a modified particle orbit in a regular nonagonal charged particle orbit control device having a two-cycle orbit.
Figure 5C:
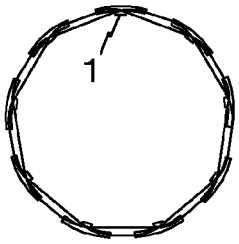
FIG. 5C is a diagram illustrating a configuration of a regular nonagonal charged particle orbit control device (edge-type) having a two-cycle orbit.
Figure 5D:
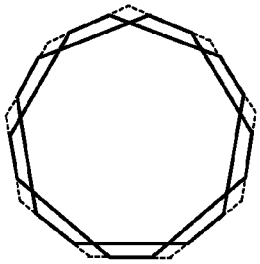
FIG. 5D is a diagram illustrating particle orbit bends in a regular nonagonal charged particle orbit control device (edge-type) having a two-cycle orbit.

It is possible to modify the shape of the lattice in a regular nonagon as illustrated in FIGS. 5B and 5C. With this lattice, it is ultimately possible to modify the shape to have an edge-type particle orbit, as illustrated in FIG. 5D. With an edge-type lattice, the bending magnets 1 bend the charged particle 3 such that the orbit of the cycling charged particle 3 contains part of each edge of the regular nonagon, and in addition, the charged particle 3 travels along every other edge of the regular nonagon.

Figure 6A:
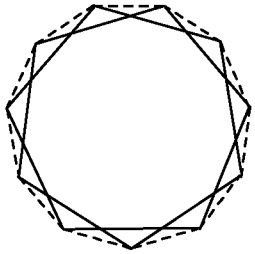
FIG. 6A is a diagram illustrating particle orbit bends in a regular hendecagonal charged particle orbit control device (vertex-type) having a two-cycle orbit.
Figure 6B:
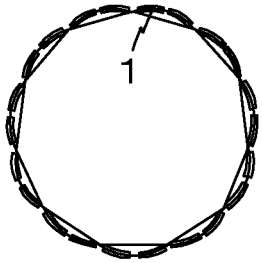
FIG. 6B is a diagram illustrating a configuration of a regular hendecagonal charged particle orbit control device (edge-type) having a two-cycle orbit.
Figure 6C:
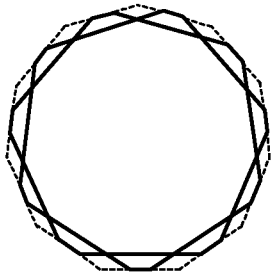
FIG. 6C is a diagram illustrating particle orbit bends in a regular hendecagonal charged particle orbit control device (edge-type) having a two-cycle orbit.

As another example, it is also possible to form a regular hendecagonal lattice, as illustrated in FIGS. 6A to 6C. FIG. 6A illustrates particle orbit bends (vertex-type) when the charged particle 3 is bent such that the charged particle 3 passes through every other vertex of a regular hendecagon.

It is possible to modify the shape of the regular hendecagonal lattice as illustrated in FIG. 6B, and it is ultimately possible to modify the shape to what is called edge-type, as illustrated in FIG. 6C. With an edge-type lattice, the orbit of the cycling charged particle 3 contains part of each edge of the regular hendecagon. With an edge-type lattice, the bending magnets 1 bend the charged particle 3 such that the orbit of the cycling charged particle 3 contains part of each edge of the regular hendecagon, and in addition, the charged particle 3 travels along every other edge of the regular hendecagon.

Figure 7A:
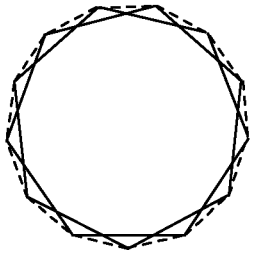
FIG. 7A is a diagram illustrating particle orbit bends in a regular tridecagonal charged particle orbit control device (vertex-type) having a two-cycle orbit.
Figure 7B:
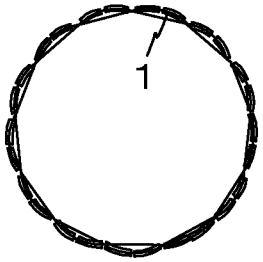
FIG. 7B is a diagram illustrating a configuration of a regular tridecagonal charged particle orbit control device (edge-type) having a two-cycle orbit.
Figure 7C:
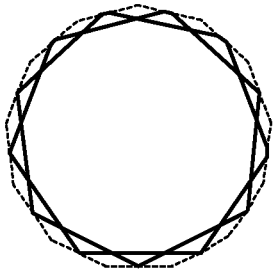
FIG. 7C is a diagram illustrating particle orbit bends in a regular tridecagonal charged particle orbit control device (edge-type) having a two-cycle orbit.

As another example, it is also possible to form a regular tridecagonal lattice, as illustrated in FIGS. 7A to 7C. FIG. 7A illustrates particle orbit bends (vertex-type) when the charged particle 3 is bent such that the charged particle 3 passes through every other vertex of a regular tridecagon.

It is possible to modify the shape of the regular tridecagonal lattice as illustrated in FIG. 7B, and it is ultimately possible to modify the shape to what is called edge-type, as illustrated in FIG. 7C. With an edge-type lattice, the orbit of the cycling charged particle 3 contains part of each edge of the regular tridecagon. With an edge-type lattice, the bending magnets 1 bend the charged particle 3 such that the orbit of the cycling charged particle 3 contains part of each edge of the regular tridecagon, and in addition, the charged particle 3 travels along every other edge of the regular tridecagon.

An edge-type charged particle orbit control device 100 will now be described in further detail.

Figure 8:
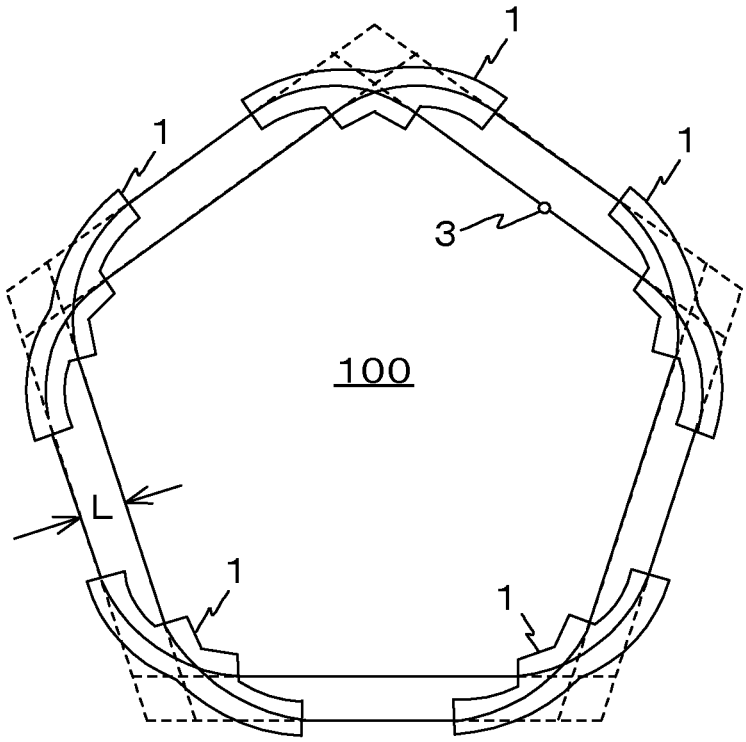
FIG. 8 is a diagram illustrating a configuration of a regular pentagonal charged particle orbit control device (edge-type) having a two-cycle orbit.

FIG. 8 illustrates an exemplary configuration of a regular pentagonal charged particle orbit control device 100 (edge-type) having a two-cycle orbit. As illustrated in FIG. 8, in this charged particle orbit control device 100 (edge-type), a bending magnet 1 provided at each vertex of the regular pentagon. Each bending magnet 1 bends the charged particle 3 such that the angle of emergence with respect to the angle of incidence becomes a given bending angle (72 degrees).

In FIG. 8, the orbit of the charged particle 3 is indicated with solid lines. In each bending magnet 1, there exist two orbits through which the charged particle 3 passes. The bending angle and relative position of each bending magnet are prescribed such that every time the charged particle 3 passes through each bending magnet 1, the orbit of the charged particle 3 in each bending magnet 1 alternately switches between the two orbits.

More specifically, in the charged particle orbit control device 100, the bending angle and relative position of each bending magnet 1 are prescribed such that every time the charged particle 3 passes through, the incident position of the charged particle 3 incident on each bending magnet 1 alternately switches between two positions. The incident position alternately switches, but since the bending angle is fixed in each bending magnet 1, the orbit of the charged particle 3 passing through the bending magnets 1 forms two types.

Note that it is necessary to design each bending magnet 1 such that the distance L and the length of the straight parts of the orbit of the charged particle 3 are suited to the usage of the charged particle orbit control device 100. Also, although the pole tips of the bending magnets 1 are orthogonal to the orbit, an arbitrary angle is typically selectable.

According to the charged particle orbit control device 100 illustrated in FIG. 8, each bending magnet 1 is disposed such that the orbit of the charged particle 3 alternately switches every time the charged particle 3 passes through a bending magnet 1. For this reason, the charged particle orbit control device 100 additionally exhibits the following advantages.

(1)' The number of straight lines in the orbit of the charged particle 3 with respect to the number of bending magnets 1 is further increased over the vertex-type charged particle orbit control device 100 illustrated in FIG. 1.

(2)' Since it is possible to increase the number of bending magnets 1 through which the charged particle 3 passes during one cycle, it is possible to decrease the bending angle while increasing the number of straight lines. For this reason, it is possible to realize lower emittance (smaller diameter) in the particle beam.

Second Embodiment

First, a second embodiment of the present invention will be described.

The charged particle orbit control device 100 according to the present embodiment differs from the foregoing first embodiment in that the charged particle 3 returns to the original orbit in three cycles rather than two cycles. In other words, in the present embodiment, m=3.

Figure 9:
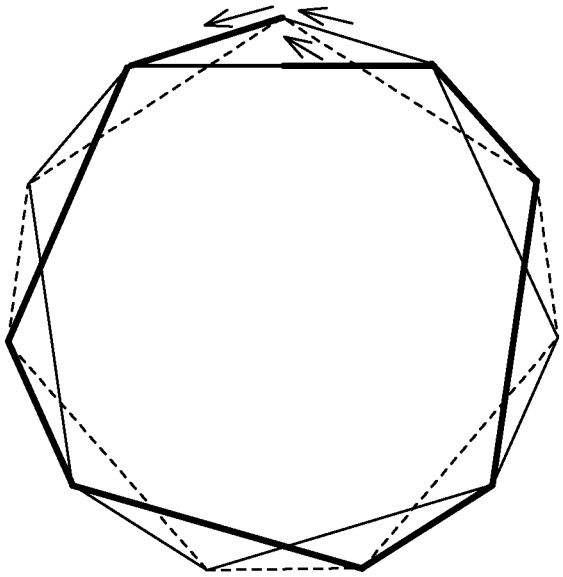
FIG. 9 is a diagram illustrating particle orbit bends in a charged particle orbit control device according to the second embodiment of the present invention.

FIG. 9 illustrates particle orbit bends in a charged particle orbit control device 100 according to the present embodiment. As illustrated in FIG. 9, the particle orbit bends are constructed on the basis of a regular hendecagon.

Among the particle orbit bends in FIG. 9, the orbit of the first cycle of the charged particle 3 is indicated in bold lines. Also, among the particle orbit bends, the orbit of the second cycle of the charged particle 3 is indicated in solid lines. In addition, among the particle orbit bends, the orbit of the third cycle of the charged particle 3 is indicated in dotted lines. As illustrated in FIG. 9, with these particle orbit bends, the charged particle 3 returns to the original orbit in three cycles.

Figure 10A:
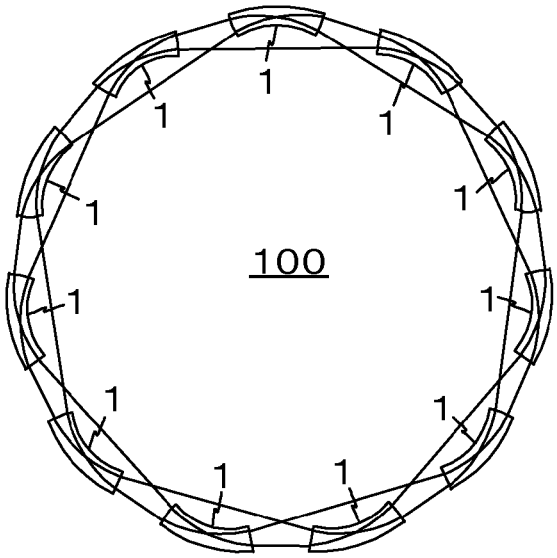
FIG. 10A is a top view illustrating a configuration of a charged particle orbit control device (double-bend-type) having the particle orbit bends in FIG. 9.

FIG. 10A illustrates an exemplary configuration of a charged particle orbit control device 100 according to the present embodiment. As illustrated in FIG. 10A, in the charged particle orbit control device 100, a bending magnet 1 is respectively disposed at each vertex of a regular hendecagon.

The bending magnet 1 bends a charged particle 3 arriving from a neighboring vertex on one side towards the vertex neighboring the neighboring vertex on the other side. Also, the bending magnet 1 bends a charged particle 3 arriving from another vertex neighboring the neighboring vertex on the one side towards the neighboring vertex on the other side. In terms of the charged particle orbit, with this layout the two neighboring bending magnets at each vertex of the regular hendecagon work as a group to bend (deflect) the orbit of the charged particle 3 towards another vertex that neighbors the neighboring vertices. Hereinafter, this type of lattice will also be called a double-bend-type.

Figure 10B:
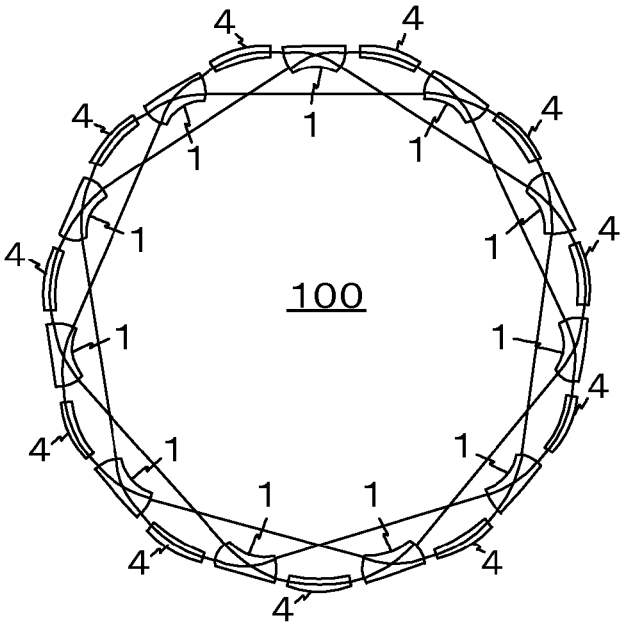
FIG. 10B is a top view illustrating a configuration of a charged particle orbit control device (triple-bend-type) having the particle orbit bends in FIG. 9.

As illustrated in FIG. 10B, with this charged particle orbit control device 100 it is also possible to additionally dispose, between each of the vertices of the regular hendecagon, a bending magnet 4 that bends the charged particle 3 exiting one vertex towards a neighboring vertex. With this layout, the three bending magnets made up of the bending magnets 1 at two adjacent vertices of the regular hendecagon, with the addition of a bending magnet 4 disposed therebetween, work as a group to bend the orbit of the charged particle 3. Hereinafter, this type of lattice will also be called a triple-bend-type.

Note that the lattice in which the number of cycles m is 3 is not limited to being based on a regular hendecagon.

Figure 11A:
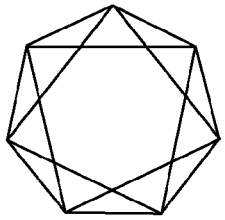
FIG. 11A is a diagram illustrating particle orbit bends in a double-bend-type charged particle orbit control device based on a regular heptagon.
Figure 11B:
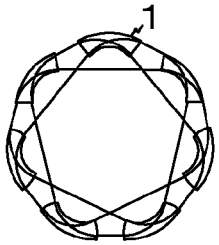
FIG. 11B is a diagram illustrating a configuration of a double-bend-type charged particle orbit control device based on a regular heptagon.
Figure 11C:
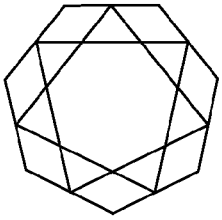
FIG. 11C is a diagram illustrating particle orbit bends in a triple-bend-type charged particle orbit control device based on a regular heptagon.
Figure 11D:
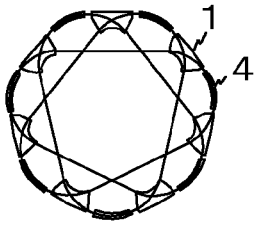
FIG. 11D is a diagram illustrating a configuration of a triple-bend-type charged particle orbit control device based on a regular heptagon.

FIG. 11A illustrates double-bend-type particle orbit bends based on a regular heptagon, while FIG. 11B illustrates the layout of the bending magnets 1 in such a lattice. In addition, FIG. 11C illustrates triple-bend-type particle orbit bends based on a regular heptagon, while FIG. 11D illustrates the layout of the bending magnets 1 and 4 in such a lattice.

Figure 12A:
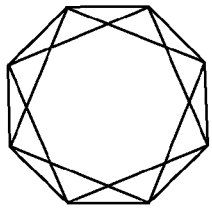
FIG. 12A is a diagram illustrating particle orbit bends in a double-bend-type charged particle orbit control device based on a regular octagon.
Figure 12B:
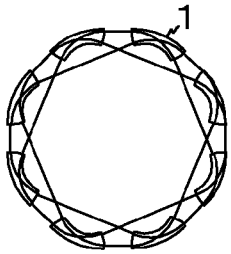
FIG. 12B is a diagram illustrating a configuration of a double-bend-type charged particle orbit control device based on a regular octagon.
Figure 12C:
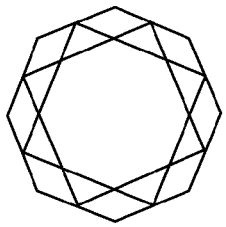
FIG. 12C is a diagram illustrating particle orbit bends in a triple-bend-type charged particle orbit control device based on a regular octagon.
Figure 12D:
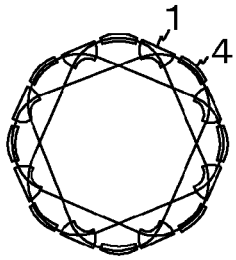
FIG. 12D is a diagram illustrating a configuration of a triple-bend-type charged particle orbit control device based on a regular decagon.

FIG. 12A illustrates double-bend-type particle orbit bends based on a regular octagon, while FIG. 12B illustrates the layout of the bending magnets 1 in such a lattice. In addition, FIG. 12C illustrates triple-bend-type particle orbit bends based on a regular octagon, while FIG. 12D illustrates the layout of the bending magnets 1 and 4 in such a lattice.

Figure 13A:
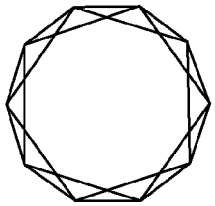
FIG. 13A is a diagram illustrating particle orbit bends in a double-bend-type charged particle orbit control device based on a regular decagon.
Figure 13B:
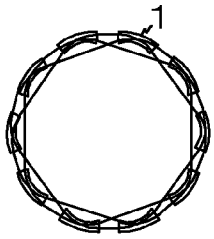
FIG. 13B is a diagram illustrating a configuration of a double-bend-type charged particle orbit control device based on a regular decagon.
Figure 13C:
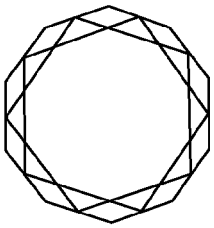
FIG. 13C is a diagram illustrating particle orbit bends in a triple-bend-type charged particle orbit control device based on a regular decagon.
Figure 13D:
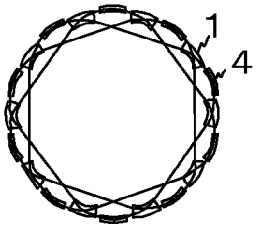
FIG. 13D is a diagram illustrating a configuration of a triple-bend-type charged particle orbit control device based on a regular decagon.

FIG. 13A illustrates double-bend-type particle orbit bends based on a regular decagon, while FIG. 13B illustrates the layout of the bending magnets 1 in such a lattice. In addition, FIG. 13C illustrates triple-bend-type particle orbit bends based on a regular decagon, while FIG. 13D illustrates the layout of the bending magnets 1 and 4 in such a lattice.

Figure 14A:
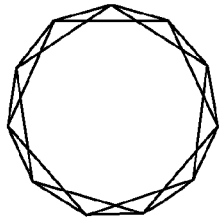
FIG. 14A is a diagram illustrating particle orbit bends in a double-bend-type charged particle orbit control device based on a regular hendecagon.
Figure 14B:
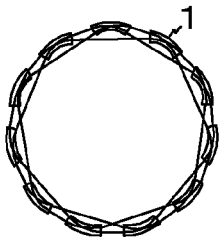
FIG. 14B is a diagram illustrating a configuration of a double-bend-type charged particle orbit control device based on a regular hendecagon.
Figure 14C:
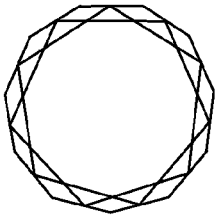
FIG. 14C is a diagram illustrating particle orbit bends in a triple-bend-type charged particle orbit control device based on a regular hendecagon.
Figure 14D:
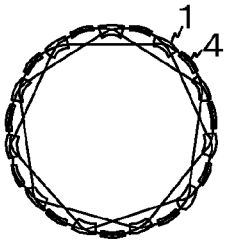
FIG. 14D is a diagram illustrating a configuration of a triple-bend-type charged particle orbit control device based on a regular hendecagon.

FIG. 14A illustrates double-bend-type particle orbit bends based on a regular hendecagon, while FIG. 14B illustrates the layout of the bending magnets 1 in such a lattice. In addition, FIG. 14C illustrates triple-bend-type particle orbit bends based on a regular hendecagon, while FIG. 14D illustrates the layout of the bending magnets 1 and 4 in such a lattice.

Figure 15A:
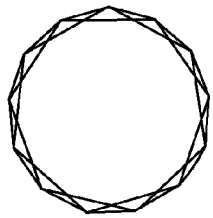
FIG. 15A is a diagram illustrating particle orbit bends in a double-bend-type charged particle orbit control device based on a regular tridecagon.
Figure 15B:
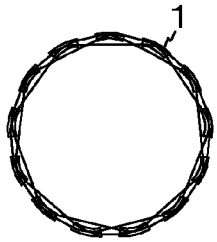
FIG. 15B is a diagram illustrating a configuration of a double-bend-type charged particle orbit control device based on a regular tridecagon.
Figure 15C:
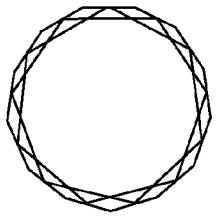
FIG. 15C is a diagram illustrating particle orbit bends in a triple-bend-type charged particle orbit control device based on a regular tridecagon.
Figure 15D:
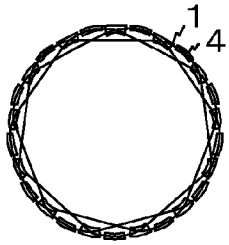
FIG. 15D is a diagram illustrating a configuration of a triple-bend-type charged particle orbit control device based on a regular tridecagon.

FIG. 15A illustrates double-bend-type particle orbit bends based on a regular tridecagon, while FIG. 15B illustrates the layout of the bending magnets 1 in such a lattice. In addition, FIG. 15C illustrates triple-bend-type particle orbit bends based on a regular tridecagon, while FIG. 15D illustrates the layout of the bending magnets 1 and 4 in such a lattice.

In the charged particle orbit control device 100 according to the present embodiment, the number of cycles in which the charged particle 3 returns to the original orbit is three cycles, with three ring cycles making one period. Thus, the path length is substantially tripled or more within the same installation area. Lengthening the path length exhibits the advantages indicated below.

(1) In the case of single-bunch operation, the bunch interval is triple the ordinary interval. For example, in TOF conducted with a small-scale radiation source electron storage ring (time-resolved photoemission spectroscopy experiments, for example), it becomes possible to track the change over time in the electronic state of matter all the way to the end state.

(2) In the case of multi-bunch operation, the amount of stored charge is potentially tripled at maximum. For example, since the path length is tripled within the same installation area, the maximum number of charged particles storable in the ring is also tripled. Thus, in the case of application to an accelerator for medical applications, such as for radiation therapy, for example, the radiation dose potentially radiated in a beam onto an affected area within the same treatment time is significantly increased. As a result, it is possible to greatly reduce the total treatment time.

(3) The number of straight parts allowing insertion of an insertion device or RF cavity is significantly increased. Thus, it becomes possible to install a greater number of experimental stations able to utilize high-intensity light.

The charged particle orbit control device 100 includes multiple bending magnets 1 that bend the charged particle 3, and the bending angle and relative position of each bending magnet 1 are prescribed such that every time the charged particle 3 passes through, the orbit of the charged particle 3 in each bending magnet 1 alternately switches between the two orbits.

In further detail, in the charged particle orbit control device 100, the bending angle and relative position of each bending magnet 1 are prescribed such that every time the charged particle 3 passes through, the incident position of the charged particle 3 incident on each bending magnet 1 alternately switches between two positions. In addition, in the charged particle orbit control device 100, the bending angle and relative position of each bending magnet 1 are prescribed such that every time the charged particle 3 passes through, the incident angle of the charged particle incident on each bending magnet 1 alternately switches between two angles.

The charged particle orbit control device 100 according to the present embodiment has the following advantages.

(1)' The number of straight lines in the orbit of the charged particle 3 with respect to the number of bending magnets 1 is further increased over the two-cycle, vertex-type charged particle orbit control device 100 (see FIG. 1) (that is, over the case of alternately skipping each bending magnet 1).

(2)' Since it is possible to increase the number of bending magnets 1 through which the charged particle 3 passes during one cycle, it is possible to decrease the bending angle while increasing the number of straight lines. For this reason, it is possible to realize lower emittance in the particle beam.

Third Embodiment

First, a third embodiment of the present invention will be described.

Figure 16:
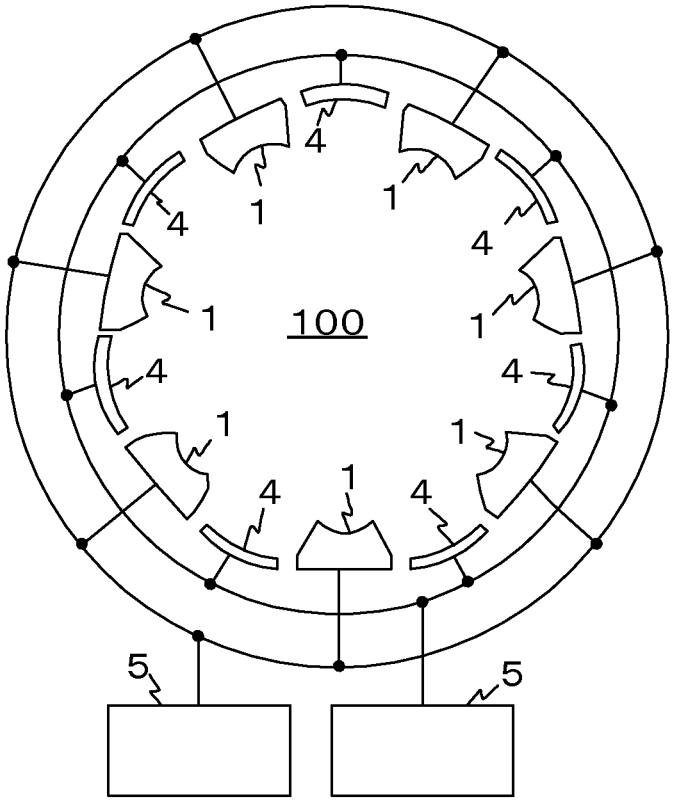
FIG. 16 is a top view illustrating a configuration of a charged particle orbit control device according to the third embodiment of the present invention.

The charged particle orbit control device 100 in FIG. 16 according to the present embodiment is a device able to switch the number of cycles m over which the charged particle 3 returns to the original orbit. The charged particle orbit control device 100 is equipped with bending magnets 1 and 4.

The charged particle orbit control device 100 is additionally equipped with an electromagnet power source 5 that controls the magnetic force of each of the bending magnets 1 and 4. In the present embodiment, it is possible to switch the number of cycles m from 1 to 3 by having the electromagnet power source 5 adjust the magnetic force of the bending magnets 1 and 4.

The lattice in the charged particle orbit control device 100 is based on a regular heptagon. In the present embodiment, n=7. The number n is a natural number that is neither a multiple of 2 nor a multiple of 3.

Figure 17A:
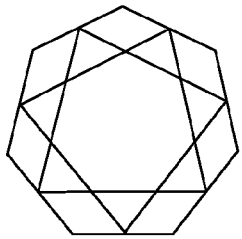
FIG. 17A is a diagram illustrating triple-bend-type, regular heptagonal particle orbit bends.

FIG. 17A illustrates triple-bend-type particle orbit bends based on a regular heptagon.

Figure 17B:
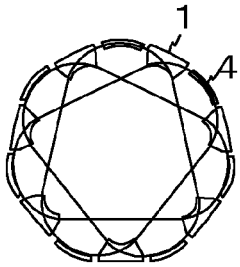
FIG. 17B is a diagram illustrating a three-cycle orbit of charged particles in a charged particle orbit control device having a triple-bend-type lattice based on a regular heptagon.

FIG. 17B illustrates a three-cycle orbit of the charged particle 3 according to a triple-bend-type lattice. In order to realize such an orbit, the electromagnet power source 5 sets the magnetic force of the bending magnets 1 centrally positioned on each edge of the regular heptagon to a magnitude such that a charged particle 3 arriving from a neighboring bending magnet 4 on one side is bent towards another bending magnet 1 centrally positioned on the edge neighboring the neighboring edge on the other side, and such that a charged particle 3 arriving from another bending magnet 1 centrally positioned on the edge neighboring the neighboring edge on the one side is bent towards the neighboring bending magnet 4. The electromagnet power source 5 also sets the magnitude of the magnetic force of the bending magnets 4 to a magnitude such that a charged particle 3 exiting a neighboring bending magnet 1 on one side is bent towards a neighboring bending magnet 1 on the other side.

Figure 17C:
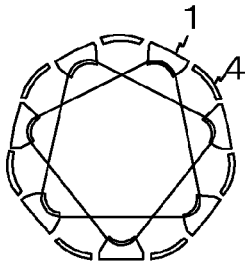
FIG. 17C is a diagram illustrating a two-cycle orbit of charged particles in a charged particle orbit control device having a triple-bend-type lattice based on a regular heptagon.

FIG. 17C illustrates a two-cycle orbit of the charged particle 3 according to a triple-bend-type lattice. In order to realize such an orbit, the electromagnet power source 5 sets the magnetic force of the bending magnets 1 to a magnitude such that the charged particle 3 passes through every other bending magnet 1 at the center of each edge of the regular heptagon. In this case, the charged particle 3 does not pass through the bending magnets 4, and thus the magnitude of the magnetic force of the bending magnets 4 is set to 0.

Figure 17D:
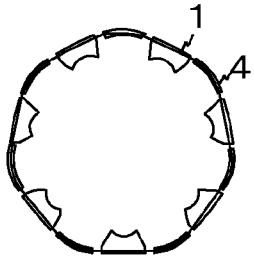
FIG. 17D is a diagram illustrating a one-cycle orbit of charged particles in a charged particle orbit control device having a triple-bend-type lattice based on a regular heptagon.

FIG. 17D illustrates a one-cycle orbit of the charged particle 3 according to such a lattice. In order to realize such an orbit, the electromagnet power source 5 sets the magnitude of the magnetic force of the bending magnets 1 to 0, and sets the magnitude of the magnetic force of the bending magnets 4 such that the charged particle 3 passes through every vertex of the regular heptagon along the edges.

Figure 18A:
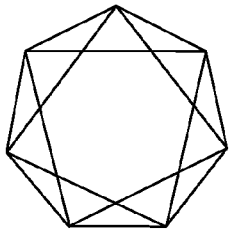
FIG. 18A is a diagram illustrating double-bend-type, regular heptagonal particle orbit bends.

FIG. 18A illustrates double-bend-type particle orbit bends based on a regular heptagon.

Figure 18B:
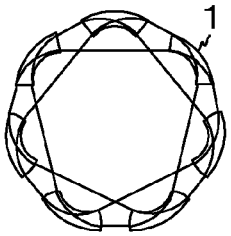
FIG. 18B is a diagram illustrating a three-cycle orbit of charged particles in a charged particle orbit control device having a double-bend-type lattice based on a regular heptagon.

FIG. 18B illustrates a three-cycle orbit of the charged particle 3 according to a double-bend-type lattice. In order to realize such an orbit, the electromagnet power source 5 sets the magnitude of the magnetic force of the bending magnets 1 positioned at each vertex of the regular heptagon to a magnitude such that a charged particle 3 arriving from a neighboring vertex on one side is bent towards the vertex neighboring the neighboring vertex on the other side, and such that a charged particle 3 arriving from another vertex neighboring the neighboring vertex on the one side is bent towards the neighboring vertex on the other side.

Figure 18C:
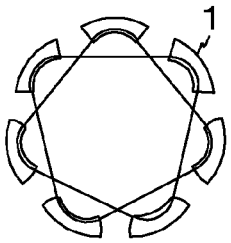
FIG. 18C is a diagram illustrating a two-cycle orbit of charged particles in a charged particle orbit control device having a double-bend-type lattice based on a regular heptagon.

FIG. 18C illustrates a two-cycle orbit of the charged particle 3 according to a double-bend-type lattice. In order to realize such an orbit, the electromagnet power source 5 sets the magnitude of the magnetic force of the bending magnets 1 to a magnitude such that the charged particle 3 passes through every other vertex of the regular heptagon.

Figure 18D:
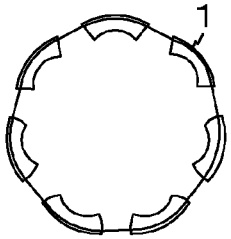
FIG. 18D is a diagram illustrating a one-cycle orbit of charged particles in a charged particle orbit control device having a double-bend-type lattice based on a regular heptagon.

FIG. 18D illustrates a one-cycle orbit of the charged particle 3 according to such a lattice. In order to realize such an orbit, the electromagnet power source 5 sets the magnitude of the magnetic force of the bending magnets 1 to a magnitude such that the charged particle 3 passes through every vertex of the regular heptagon along the edges.

Figure 19A:
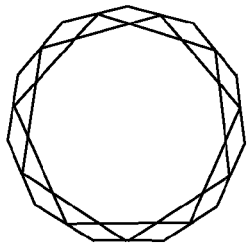
FIG. 19A is a diagram illustrating triple-bend-type, regular hendecagonal particle orbit bends.
Figure 19B:
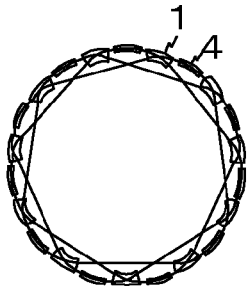
FIG. 19B is a diagram illustrating a three-cycle orbit of charged particles in a charged particle orbit control device having a triple-bend-type lattice based on a regular hendecagon.
Figure 19C:
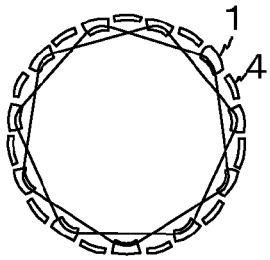
FIG. 19C is a diagram illustrating a two-cycle orbit of charged particles in a charged particle orbit control device having a triple-bend-type lattice based on a regular hendecagon.
Figure 19D:
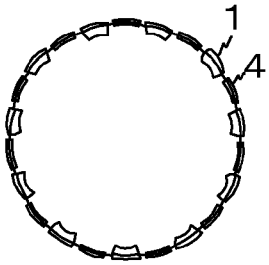
FIG. 19D is a diagram illustrating a one-cycle orbit of charged particles in a charged particle orbit control device having a triple-bend-type lattice based on a regular hendecagon.

In addition, FIG. 19A illustrates triple-bend-type particle orbit bends based on a regular hendecagon. Also, FIGS. 19B to 19D respectively illustrate a three-cycle orbit, a two-cycle orbit, and a one-cycle orbit of the charged particle 3 according to a triple-bend-type lattice based on a regular hendecagon. Switching among these ring orbits is likewise possible by having the electromagnet power source 5 adjust the magnitudes of the magnetic force of the bending magnets 1 and 4 as described above.

Figure 20A:
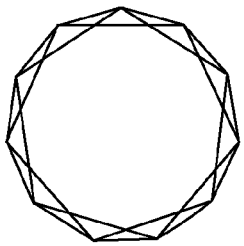
FIG. 20A is a diagram illustrating double-bend-type, regular hendecagonal particle orbit bends.
Figure 20B:
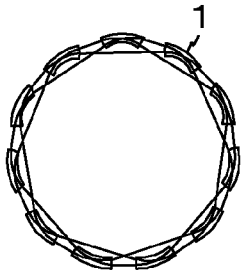
FIG. 20B is a diagram illustrating a three-cycle orbit of charged particles in a charged particle orbit control device having a double-bend-type lattice based on a regular hendecagon.
Figure 20C:
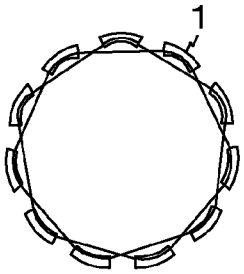
FIG. 20C is a diagram illustrating a two-cycle orbit of charged particles in a charged particle orbit control device having a double-bend-type lattice based on a regular hendecagon.
Figure 20D:
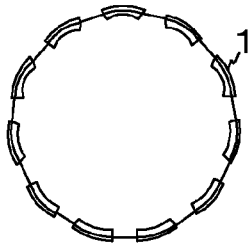
FIG. 20D is a diagram illustrating a one-cycle orbit of charged particles in a charged particle orbit control device having a double-bend-type lattice based on a regular hendecagon.

In addition, FIG. 20A illustrates double-bend-type particle orbit bends based on a regular hendecagon. Also, FIGS. 20B to 20D respectively illustrate a three-cycle orbit, a two-cycle orbit, and a one-cycle orbit of the charged particle 3 according to a double-bend-type lattice based on a regular hendecagon. Switching among these ring orbits is likewise possible by having the electromagnet power source 5 adjust the magnitude of the magnetic force of the bending magnets 1 as described above.

The charged particle orbit control device 100 according to the present embodiment is able to switch a single period of the charged particle 3 from one cycle to three cycles. According to this charged particle orbit control device 100, it becomes possible to adjust the path length of the orbit of the charged particle 3 according to the intended purpose.

Note that edge-type lattices typically have fewer bending magnets and more straight lines compared to vertex-type lattices. However, with an edge-type lattice, since the straight-line orbit in the first cycle and the straight-line orbit in the second cycle tend to be in proximity, the need to separate the two straight-line orbits to some degree should be noted.

Note that although the foregoing describes various lattices, the lattice in the charged particle orbit control device 100 is not limited to being in accordance with the foregoing embodiments.

Figure 21:
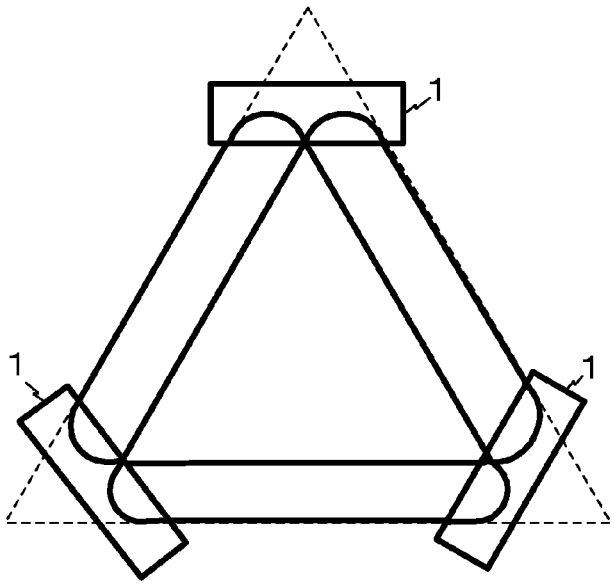
FIG. 21 is a top view illustrating a configuration (1 of 2) of a charged particle orbit control device having a lattice based on a regular triangle.
Figure 22:
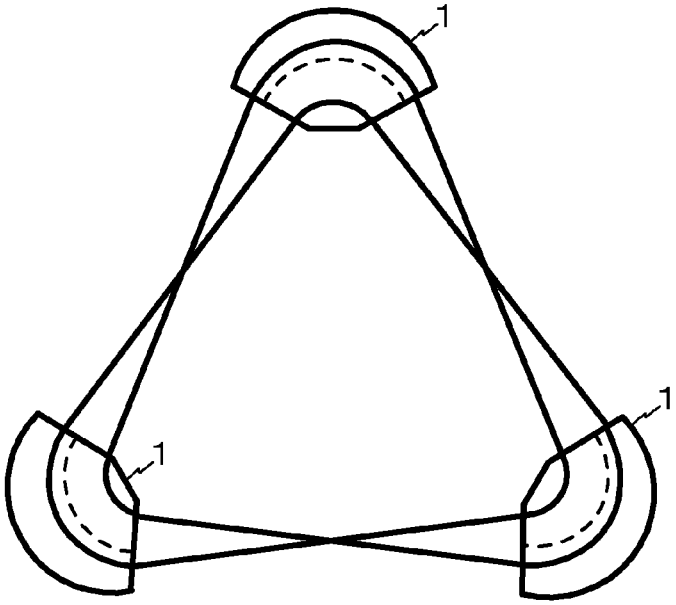
FIG. 22 is a top view illustrating a configuration (2 of 2) of a charged particle orbit control device having a lattice based on a regular triangle.

For example, it is also possible to form a lattice based on a regular triangle, as illustrated in FIGS. 21 and 22. The lattice illustrated in FIG. 21 is what is called an edge-type, two-cycle (m=2) lattice. The lattice illustrated in FIG. 22 is also a two-cycle (m=2) lattice, but in this lattice, an outer vertex and an inner vertex are respectively disposed in correspondence with each vertex of the regular triangle, and the charged particle 3 assumes an orbit that alternately passes through the outer vertices and the inner vertices. With the charged particle orbit control device illustrated in FIG. 22, the bending magnets are manufactured and adjusted such that, with respect to the orbit of a charged particle inside the bending magnets installed at each vertex of the regular triangle, the bending angle is small on the inner orbit, and the bending angle is large on the outer orbit. Thus, a charged particle alternately passes through the inner and outer sides every time the charged particle passes through a neighboring bending magnet.

Figure 23:
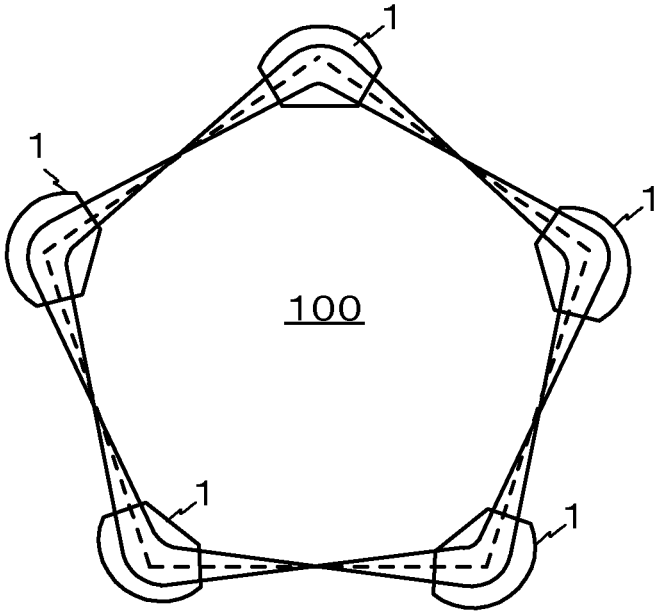
FIG. 23 is a top view illustrating an example of a configuration of a charged particle orbit control device having a lattice based on a regular pentagon.

Additionally, with a lattice based on a regular pentagon, it is also possible to form a lattice as illustrated in FIG. 23. Likewise with this lattice, an outer vertex and an inner vertex are respectively disposed in correspondence with each vertex of the regular pentagon, and the charged particle 3 assumes an orbit that alternately passes through the outer vertices and the inner vertices. With the charged particle orbit control device illustrated in FIG. 23, the bending magnets are manufactured and adjusted such that, with respect to the orbit of a charged particle inside the bending magnets installed at each vertex of the regular pentagon, the bending angle is small on the inner orbit, and the bending angle is large on the outer orbit. Thus, a charged particle alternately passes through the inner and outer sides every time the charged particle passes through a neighboring bending magnet.

In other words, in each bending magnet 1, there exist two orbits through which the charged particle 3 passes. The bending angle and relative position of each bending magnet are prescribed such that every time the charged particle 3 passes through each bending magnet 1, the orbit of the charged particle 3 in each bending magnet 1 alternately switches between the two orbits.

More specifically, in this charged particle orbit control device 100, the bending angle and relative position of each bending magnet 1 are likewise prescribed such that every time the charged particle 3 passes through, the incident position of the charged particle 3 incident on each bending magnet 1 alternately switches between two positions. Also, in this charged particle orbit control device 100, the bending angle and relative position of each bending magnet are prescribed such that every time the charged particle 3 passes through, the incident angle of the charged particle incident on each bending magnet 1 alternately switches between two angles.

The strength of the magnetic field of each bending magnet 1 is prescribed such that the bending angle of a charged particle 3 incident on the inner side of the orbit becomes slightly less than 72 degrees, and such that the bending angle of a charged particle 3 incident on the outer side of the orbit becomes slightly larger than 72 degrees. Thus, in each bending magnet 1, a charged particle 3 passing through the inner orbit and incident on each bending magnet 1 heads towards the outer orbit, while a charged particle 3 passing through the outer orbit and incident on each bending magnet 1 heads towards the inner orbit.

According to such orbit settings for the charged particle 3 and the placement of each bending magnet 1, the orbit of the charged particle 3 intersects on the straight parts of the orbits in the charged particle orbit control device 100 illustrated in FIG. 23. The orbit intersection angle at which the orbit intersects on the straight parts is determined by the distance between the inner and outer n-sided polygons, and the edge lengths thereof.

Note that in this charged particle orbit control device 100, it is still necessary to design each bending magnet 1 such that the length of the straight parts of the orbit of the charged particle 3 and the like are suited to the usage of the charged particle orbit control device 100. Although the pole tips of these bending magnets 1 are orthogonal to the orbit, an arbitrary angle is typically selectable.

Also, although the foregoing embodiments describe lattices in which the charged particle 3 returns to the original orbit in two cycles or three cycles, the present invention is not limited thereto. For example, it is also possible to form a lattice in which the charged particle 3 returns to the original orbit in four or more cycles.

In any case, m is a natural number other than 1, and n is a natural number that is not a multiple of m.

Figure 24:
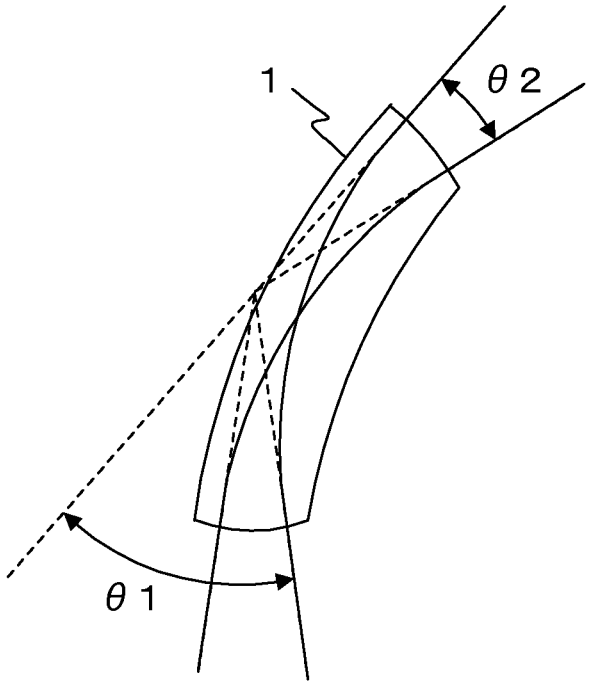
FIG. 24 is a diagram for explaining a bending angle and an orbit intersection angle.

In this way, in a charged particle orbit control device 100 according to the foregoing embodiments, the bending magnet 1 has two intersecting orbits, as illustrated in FIG. 24. The bending angle θ1 and the orbit intersection angle θ2 in a bending magnet 1 is computed geometrically.

The two angles that characterize the structure of a bending magnet 1 in an charged particle orbit control device 100 having an n-sided polygonal shape and m cycles are summarized below, classified into the two types of the double-bend type and the triple-bend type.

First, in the case of a double-bend-type charged particle orbit control device 100, a single inner angle of the n-sided regular polygon becomes 180(n−2)/n [deg.], and the total sum of bending angles θ1 becomes 360×m [deg.]. In addition, the total number of bending magnets 1 through which the charged particle 3 passes in one period becomes 2×n. In this case, the bending angle θ1 of each bending magnet 1 becomes the following formula.

MATH. 1

$$\theta 1=360\times m/(2\times n)=180m/n[\text{deg.}] \quad (1)$$

Also, the intersection angle θ2 between two orbits becomes the following formula.

MATH. 2

$$\theta 2=180(n-2)/n-(180-180m/n)=180(m-2)/n[\text{deg.}] \quad (2)$$

Intersection angles θ2 in a double-bend-type charged particle orbit control device 100 having an n-sided polygonal shape and m cycles are summarized in the following table.

TABLE 1

| | m = 3 | m = 4 | m = 5 |
|---|---|---|---|
| n = 5 | 36 | 72 | — |
| n = 6 | — | — | 90 |
| n = 7 | 25.71 | 51.43 | 77.14 |
| n = 8 | 22.5 | — | 67.5 |
| n = 9 | — | 40 | 60 |
| n = 10 | 18 | — | — |
| n = 11 | 16.36 | 32.73 | 49.09 |
| n = 12 | — | — | 45 |

Next, in the case of a triple-bend-type charged particle orbit control device 100, a single inner angle of the n-sided regular polygon becomes 180(n−2)/n [deg.], and the total sum of bending angles θ1 becomes 360×m [deg.]. Also, the total number of bending magnets 1 through which the charged particle 3 passes becomes n for the bending magnets 4 in which the orbit does not intersect, and 2×n for the bending magnets 1 in which the orbit does intersect. In this case, the bending angle θ1 of each of the bending magnets 1 and 4 becomes

MATH. 3

$$\theta 1=360/n[\text{deg.}] \quad (3)$$

for the bending magnets 4 without intersection, and

MATH. 4

$$\theta 1=[360\times m-n\times(360/n)]/(2\times n)=180(m-1)/n[\text{deg.}] \quad (4)$$

for the bending magnets 1 with intersection.

Also, the intersection angle θ2 between two orbits becomes the following formula.

MATH. 5

$$\theta 2=180(m-1)/n[\text{deg.}] \quad (5)$$

Intersection angles θ1 in a triple-bend-type charged particle orbit control device 100 having an n-sided polygonal shape and m cycles are summarized in the following table.

TABLE 2

| | m = 3 | m = 4 | m = 5 |
|---|---|---|---|
| n = 5 | 72 | 108 | — |
| n = 6 | — | — | 120 |
| n = 7 | 51.43 | 77.14 | 102.86 |
| n = 8 | 45 | — | 90 |
| n = 9 | — | 60 | 80 |
| n = 10 | 36 | — | — |
| n = 11 | 32.73 | 49.09 | 65.45 |
| n = 12 | — | — | 60 |

Figure 25:
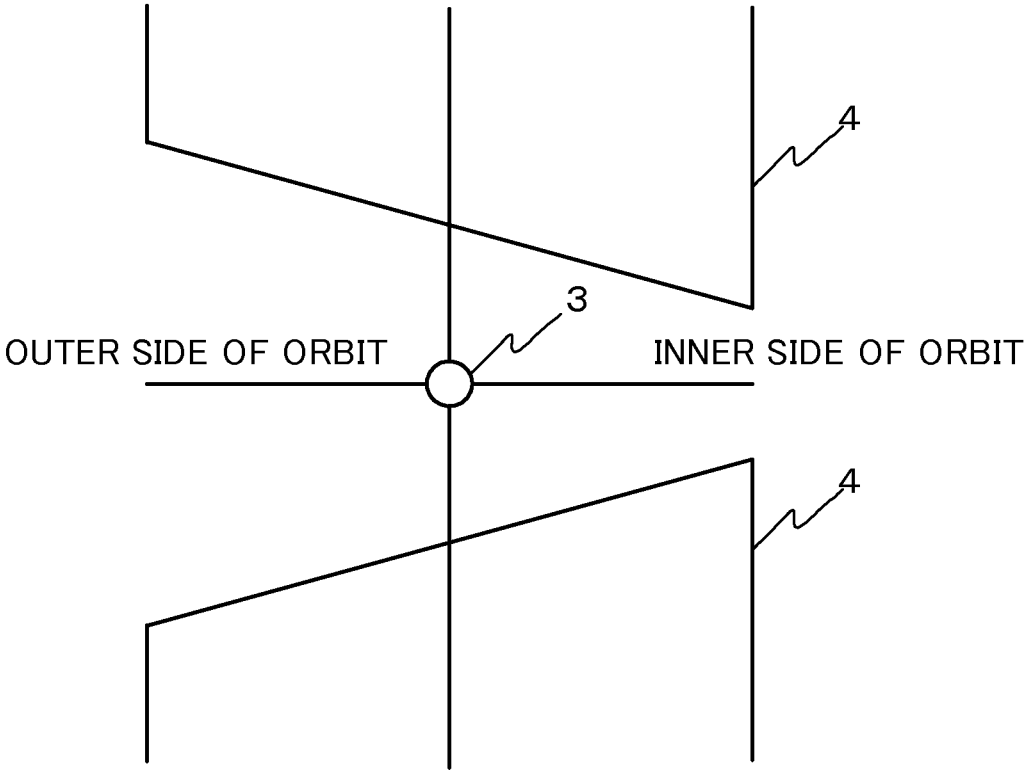
FIG. 25 is a diagram for explaining a magnetic field gradient imparted to a bending magnet.

Also, in the foregoing embodiments, a configuration is possible in which a magnetic field gradient is provided in each bending magnet 1 from the inner side to the outer side of the orbit of the charged particle 3. For example, as illustrated in FIG. 25, a magnetic field gradient is formed such that the magnetic force becomes stronger towards the inner side of the orbit for a charged particle 3 traveling in a direction orthogonal to the plane of the page. In so doing, it becomes possible to further lower the emittance of a particle beam formed by charged particles 3. Note that it is also possible to form a magnetic field gradient such that the magnetic force becomes stronger towards the outer side.

Figure 26:
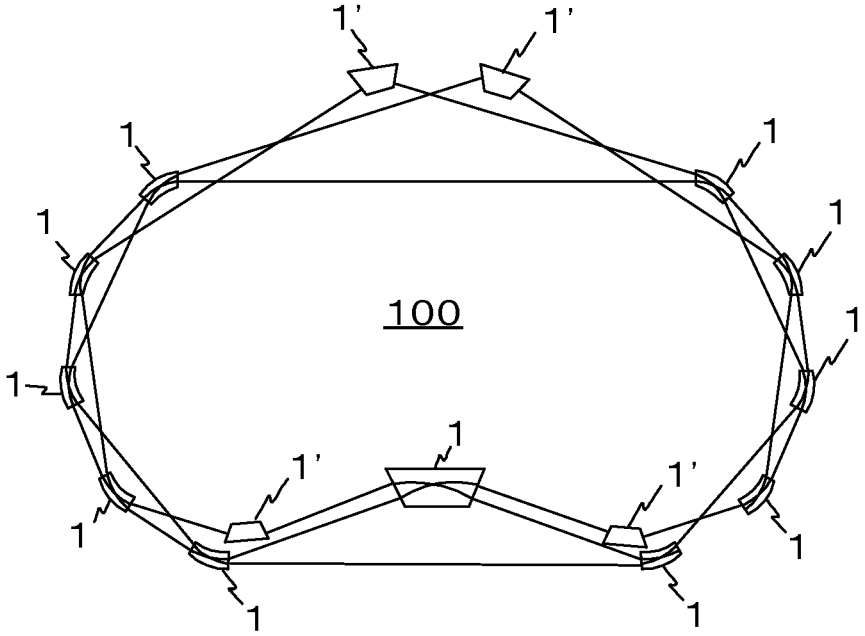
FIG. 26 is a diagram illustrating an example of a configuration of a charged particle orbit control device having a configuration that is not a regular polygon.

Also, although the each bending magnet 1 is disposed on the outer periphery of a regular polygon in the foregoing embodiments, the present invention is not limited thereto. For example, as illustrated in FIG. 26, it is also possible to dispose each bending magnet 1 on the outer periphery of a figure other than a regular polygon.

Figure 27:
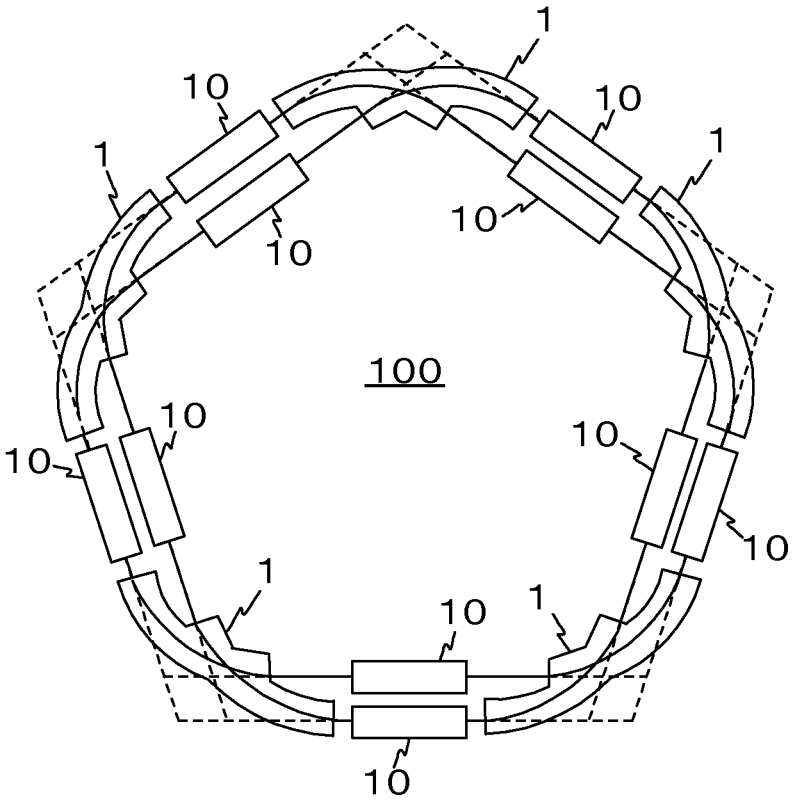
FIG. 27 is a diagram illustrating how undulators are inserted into the straight parts of a charged particle.

As illustrated in FIG. 27, various objects are disposed on the straight parts of the orbit of the charged particle 3. For example, in FIG. 27, an undulator 10 is disposed on each straight part. In this way, since there are many straight parts in the charged particle orbit control device 100, it is possible to dispose many undulators 10.

In any case, a charged particle orbit control device 100 according to the foregoing embodiments accepts a charged particle 3 incident from multiple different positions, has multiple orbits for the charged particle 3 depending on the incident position, requiring bending magnets 1 that eject the charged particle 3 from multiple different positions according to the orbit. By providing such bending magnets 1, the advantages of the charged particle orbit control device 100 discussed above are exhibited.

The present invention is not limited by the foregoing embodiments and drawings. Obviously, it is possible to modify the embodiments and drawings within a scope that does not alter the principal matter of the present invention. Essentially, the configuration is such that one period in the orbit of a charged particle has multiple cycles rather than one cycle.

In other words, various embodiments and modifications of the invention are possible without departing from the scope and spirit of the invention in the broad sense. Furthermore, the foregoing embodiments are for the purpose of describing the invention, and do not limit the scope of the invention. In other words, the scope of the invention is indicated by the claims rather than the embodiments. In addition, various alterations performed within the scope of the claims or their equivalents are to be regarded as being within the scope of the invention.

This application is based on Japanese Patent Application No. 2010-283850 filed in the Japan Patent Office on Dec. 20, 2010, and the entirety of the specification, claims, and drawings of Japanese Patent Application No. 2010-283850 are hereby incorporated by reference.

INDUSTRIAL APPLICABILITY

The present invention is suitable for use in a charged particle accelerator and charged particle storage ring, as discussed above.

Reference Signs List

| | |
|---|---|
| 1 (1A to 1K) | Bending magnet |
| 2 | Quadrupole electromagnet |

-continued

Reference Signs List

| | |
|---|---|
| 3 | Charged particle |
| 4 | Bending magnet |
| 5 | Electromagnet power source |
| 10 | Undulator |
| 100 | Charged particle orbit control device |

The invention claimed is:

1. A charged particle orbit control device, used in a ring-shaped charged particle accelerator or a charged particle storage ring, configured to enable a charged particle to return to an original orbit in a plurality of cycles, comprising:

a plurality of benders each comprising at least one bending magnet and configured to bend the charged particle, wherein a bending angle and a relative position of each of the benders are predetermined such that every time the charged particle passes through one of the benders, an orbit of the charged particle in each of the benders alternately switches between two orbits.

2. The charged particle orbit control device according to claim 1, wherein the bending angle and the relative position of each of the benders are predetermined such that every time the charged particle passes through one of the benders, an incident position of the charged particle incident on each of the benders alternately switches between two positions.

3. The charged particle orbit control device according to claim 2, wherein the bending angle and the relative position of each of the benders are predetermined such that every time the charged particle passes through one of the benders, an incident angle of the charged particle incident on each of the benders alternately switches between two angles.

4. The charged particle orbit control device according to claim 1, wherein in each of the benders, a magnetic field gradient is formed from an inner side to an outer side of the orbit of the charged particle.

5. The charged particle orbit control device according to claim 1, wherein provided that n is a natural number that is not a multiple of m, each of the benders is disposed on an outer rim of an n-sided regular polygon, and configured such that the charged particle returns to the original orbit in m cycles, where m is a natural number other than 1.

6. The charged particle orbit control device according to claim 5, wherein each of the benders bends the charged particle such that the orbit of the cycling charged particle contains part of each edge of the n-sided regular polygon, and in addition, the charged particle travels along every (m−1)th edge of the n-sided regular polygon.

7. The charged particle orbit control device according to claim 5, wherein m is 3, and the benders are respectively disposed at each vertex of the n-sided regular polygon, receive a charged particle from a neighboring vertex on one side and bend the received charged particle towards a vertex neighboring a neighboring vertex on the other side, and receive a charged particle from another vertex neighboring the neighboring vertex on the one side and bend the received charged particle towards the neighboring vertex on the other side.

8. The charged particle orbit control device according to claim 7, further comprising additional benders that bend the charged particle from a neighboring vertex on one side towards a neighboring vertex on the other side, wherein the additional benders are each provided between each two neighboring vertices of the n-sided regular polygon.

9. The charged particle orbit control device according to claim 5, further comprising:

an electromagnet power source that controls magnetic force of the bending magnet, wherein n is a natural number that is neither a multiple of 2 nor a multiple of 3, the electromagnet power source, by adjusting the magnetic force of the bending magnet, is capable of switching a number of cycles of the charged particle among the natural numbers 1 through 3.

10. A charged particle accelerator, wherein an orbit of a charged particle is controlled by the charged particle orbit control device according to claim 1.

11. A charged particle storage ring, wherein an orbit of a charged particle is controlled by the charged particle orbit control device according to claim 1.

12. A bending magnet, used in the charged particle orbit control device according to claim 1, wherein the bending magnet receives a charged particle incident from different positions, includes a plurality of different orbits for the charged particle depending on an incident position, and ejects the charged particle from a plurality of different positions according to each of the different orbits.

* * * * *